US007861651B2

(12) United States Patent
Hansson et al.

(10) Patent No.: US 7,861,651 B2
(45) Date of Patent: Jan. 4, 2011

(54) METHOD AND DEVICE FOR KEEPING A NUMBER OF SPRAY NOZZLES IN A PRINTING PRESS BEAM CLEAN

(75) Inventors: Birger Hansson, Akarp (SE); Peter Arndt, Malmo (SE)

(73) Assignee: Baldwin Jimek AB, Arlov (SE)

( * ) Notice: Subject to any disclaimer, the term of this patent is extended or adjusted under 35 U.S.C. 154(b) by 0 days.

(21) Appl. No.: 10/521,320

(22) PCT Filed: May 8, 2003

(86) PCT No.: PCT/SE03/00740

§ 371 (c)(1),
(2), (4) Date: Jul. 25, 2005

(87) PCT Pub. No.: WO03/097358

PCT Pub. Date: Nov. 27, 2003

(65) Prior Publication Data

US 2006/0086270 A1 Apr. 27, 2006

(30) Foreign Application Priority Data

May 17, 2002 (SE) ..... 0201483

(51) Int. Cl.
*B41L 25/06* (2006.01)
*B05B 7/08* (2006.01)

(52) U.S. Cl. ..... 101/147; 118/315; 239/550; 239/551

(58) Field of Classification Search ..... None
See application file for complete search history.

(56) References Cited

U.S. PATENT DOCUMENTS

| | | | | |
|---|---|---|---|---|
| 2,448,226 | A * | 8/1948 | Marsden | 101/147 |
| 3,788,273 | A * | 1/1974 | Tusch et al. | 118/305 |
| 3,864,691 | A * | 2/1975 | Schroeder | 346/74.2 |
| 4,044,674 | A * | 8/1977 | Smith, Jr. | 101/148 |
| 4,241,656 | A | 12/1980 | Smith | |
| 5,025,722 | A * | 6/1991 | Switall et al. | 101/147 |
| 5,040,457 | A * | 8/1991 | Lin | 101/147 |
| 5,299,495 | A | 4/1994 | Schoeps et al. | |
| 6,928,924 | B2 * | 8/2005 | Miyauchi et al. | 101/147 |

FOREIGN PATENT DOCUMENTS

| | | |
|---|---|---|
| EP | 0 422 400 | 4/1991 |
| WO | WO 97/27052 | 7/1997 |
| WO | WO 01/87603 | 11/2001 |

* cited by examiner

*Primary Examiner*—Jill E Culler
(74) *Attorney, Agent, or Firm*—Merchant & Gould P.C.

(57) ABSTRACT

In order to keep a spray nozzle (3) in a printing press spray beam (1) clean, air with a certain overpressure is supplied to a cover (5; 13; 24) surrounding the spray nozzle (3), the spray cone from the spray nozzle leaving the cover undisturbed through a slot (7; 16; 26) therein.

6 Claims, 2 Drawing Sheets

METHOD AND DEVICE FOR KEEPING A NUMBER OF SPRAY NOZZLES IN A PRINTING PRESS BEAM CLEAN

TECHNICAL FIELD

The present invention relates to a method and device for keeping a spray nozzle in a printing press spray beam clean.

BACKGROUND OF THE INVENTION

A spray beam is arranged in the proximity of a printing press roller for spraying fountain solution thereon. This fountain solution is needed for obtaining the intended printing function in the printing press, as is well known in the art. (Other liquids than fountain solution could alternatively be sprayed.)

It is also well known in the art that at the high speed rotation of the different rollers in the printing press, it is difficult to obviate the formation of a mist of printing ink and other matters in and around the press. The printing ink also causes certain problems in the operation of the press.

The printing ink mist causes clogging of the spray nozzles of the spray beam, so that their intended spray function gradually deteriorates and the spray pattern of the spray beam is changed.

A prior attempt to solve the problem with clogged spray nozzles in a special situation is revealed in WO 0187603, where an air stream is caused to flow towards the printing press roller in the spray casing covering the area between the spray beam and the roller.

THE INVENTION

According to the invention the above mentioned problem can be solved in that air with a certain overpressure is supplied to a cover surrounding the spray nozzle, the spray cone from the spray nozzle leaving the cover undisturbed through a slot therein.

A device for carrying out this method is characterized by a cover, which surrounds the spray nozzle and has a slot for the spray cone from the spray nozzle to leave the cover undisturbed, and by means for supplying air with a certain overpressure to the cover.

Favourable embodiments appear from the dependent claims.

THE DRAWINGS

Figure 1:
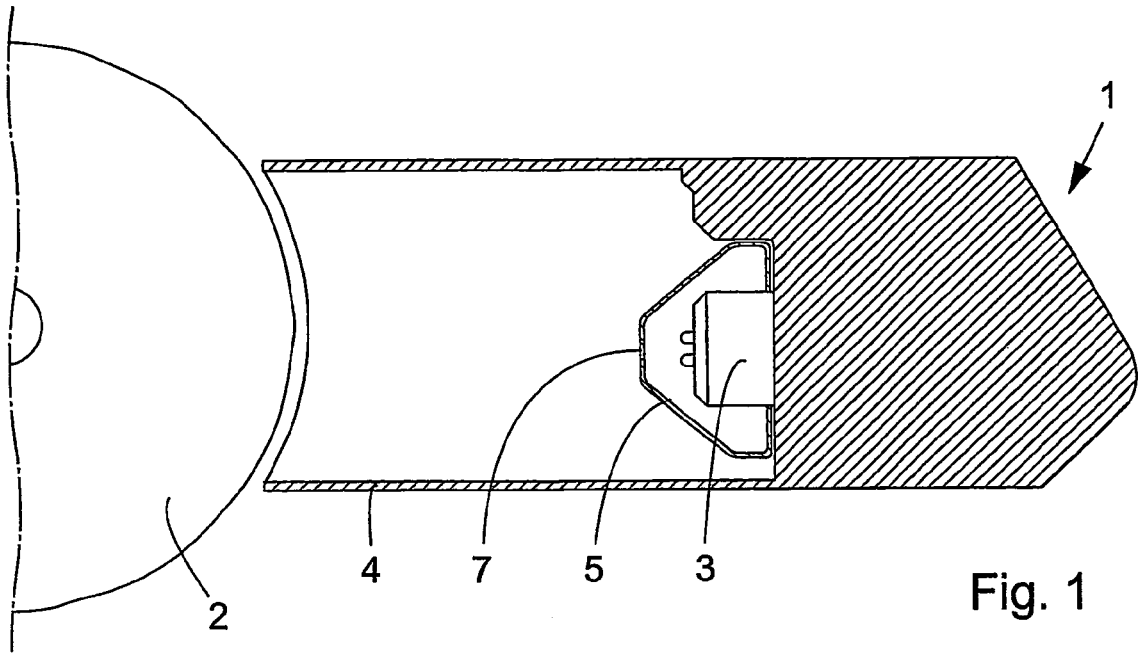
Figure 2:
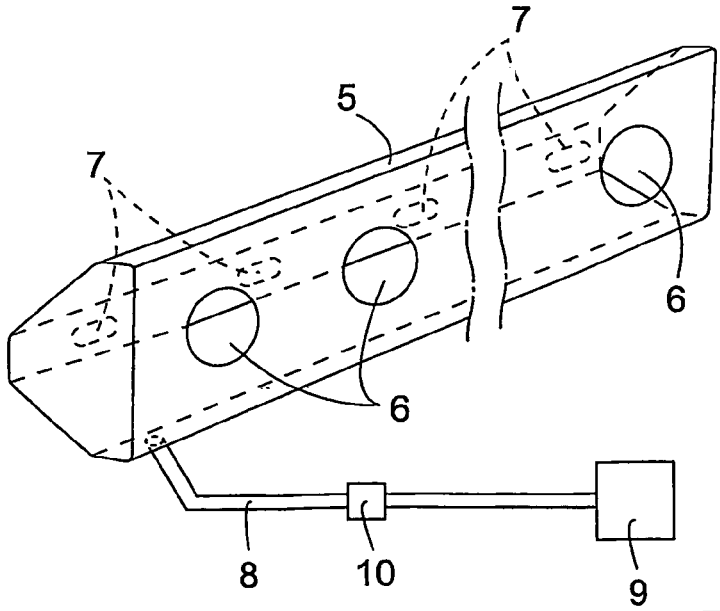
Figure 3:
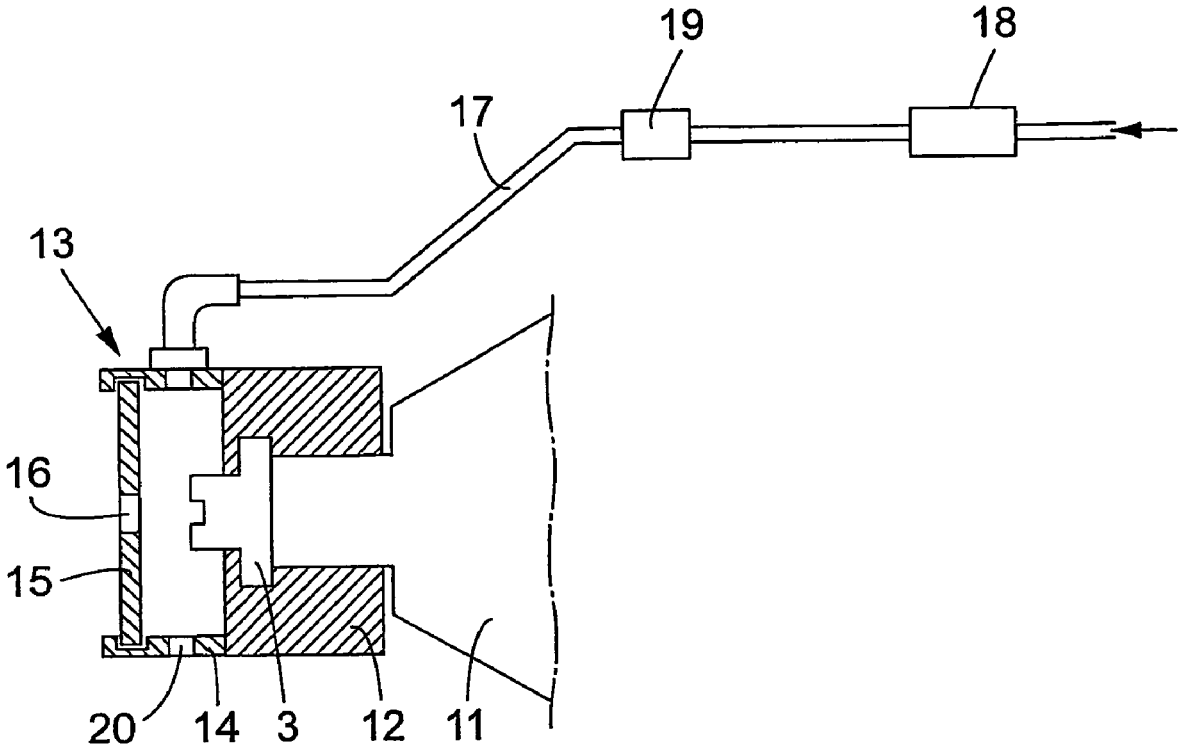
Figure 4:
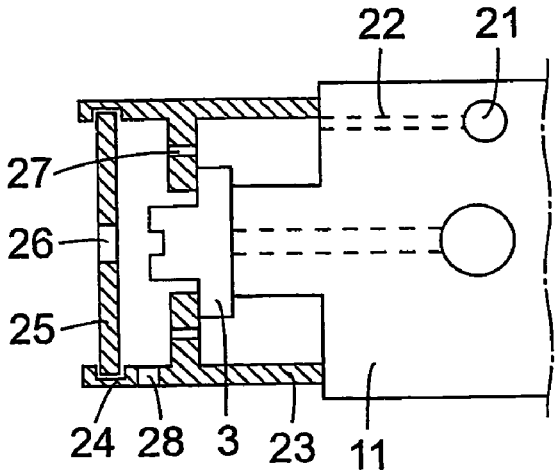

The invention will be described in further detail below under reference to the accompanying drawings, in which FIG. 1 is a diagrammatic cross section through a spray beam provided with a first device according to the invention, FIG. 2 is a perspective view of the first device of FIG. 1, FIG. 3 is a cross section through a spray nozzle with a second device according to the invention, and FIG. 4 is a cross section through a spray nozzle with a third device according to the invention.

DETAILED DESCRIPTION OF EMBODIMENTS

A so called spray beam 1 is shown in a very diagrammatic cross section in FIG. 1. The purpose of such a spray beam is to spray fountain solution on a rotating printing press roller 2. Fountain solution is sprayed from a number of spray nozzles 3, placed in a row in the spray beam, through a spray casing 4 constituting the forward portion of the spray beam 1.

The purpose of the spray casing 4 is to keep the fountain solution properly confined but also to prevent printing ink mist and other contaminants from reaching the spray nozzles 3.

However, in spite of these measures it is a known problem that the spray nozzles 3 may be clogged after a certain operation time and may fail to function properly, leading among other things to an impaired distribution of fountain solution over the width of the roller 2 to be sprayed.

Measures accordingly need to be taken to ensure that the nozzles 3 are kept clean.

FIGS. 1 and 2 show a first embodiment of a device for this purpose.

An elongated, generally closed cover 5 is mounted over all the spray nozzles 3 on the spray beam 1. The cover 5 can be formed of stainless steel plate or the like, but the choice of material is of no significance for the invention. The cover 5 is provided in its back wall with openings 6 for the spray nozzles 3 and in its front wall with oblong holes or slots 7 enabling the spray cones from the spray nozzles 3 to leave the cover 5 undisturbed.

Clean air with a certain overpressure is supplied to the interior of the cover 5 by means of an air conduit 8 from a main valve with a pressure regulator 9 and a throttle valve 10 for controlling the air flow. In order to obtain the desired result, several air conduits 8 from the throttle valve 10 may be evenly distributed over the length of the cover 5. It may possibly be desired to provide the bottom of the cover 5 with a number of drainage holes (not shown).

The air will create a certain overpressure in the cover 5 and escape through its slots 7 without disturbing the spray cones from the spray nozzles 3. In this way contaminants are effectively prevented from reaching the spray nozzles 3, which accordingly will be kept clean for an extended period of time.

A second embodiment is shown in FIG. 3. Each spray nozzle 3 is connected to its spray valve 11 in the spray beam 1 by means of a cap 12, which may be made of a plastic material.

A cover 13 is individually provided for each spray nozzle 3. In the present case it has the form of a short sleeve 14, connected in a way not shown (but possibly by means of a bayonet joint) to the cap 12 and possibly made of a plastic material, and an end plate 15 inserted in a circumferential groove in the end of the sleeve 14. The end plate 15 has an oblong slot 16 for the spray cone from the spray nozzle 3 to pass through.

An air conduit 17 for the supply of clean air with a certain overpressure is connected to the sleeve 14. The air conduit 17 can be provided with a main valve with a pressure regulator 18 and a throttle valve 19 for controlling the air flow. The members 18 and 19 may be common for several air conduits 17 to several spray nozzles 3. Means may be provided in the cover 13 for evenly distributing the air inside the cover.

The sleeve 14 may be provided with a drainage hole 20 in its bottom portion.

The provision of a separate end plate 15 is based on manufacturing considerations. As an alternative the cover 13 may be made as an integrated unit.

The embodiment according to FIG. 3 may be especially suitable for existing spray beams, as the cover arrangement for each spray nozzle may be mounted without modifications to the existing device.

The embodiment according to FIG. 4 may be more suitable for new arrangements, where the design freedom is greater. In this case the spray valve 8 is provided with a separate main air conduit 21 extending from spray valve to spray valve in the spray beam. An air bore 22 extends forward in the valve from the air conduit 21. The diameter of the bore 22 is such that a throttling for the air is accomplished in order to control the air flow.

The cap device 23 for connecting the spray nozzle 3 with the spray valve 11 is integrated with the cover arrangement 24, possibly having an end plate 25 provided with a slot 26.

A partition wall bearing against the spray nozzle 3 has a number of through holes 27 for supplying air into the cover 24, which may be provided with a drainage hole 28.

It is believed that favourable results can be obtained with an air pressure in the region of 1.0-1.5 bar, probably 1.2 bar, and an air flow of for example up to 1 litre/min or more, but these figures are in no way meant to be limiting for the scope of the invention.

The invention claimed is:

1. A device for keeping a plurality of fountain solution spray nozzles in a printing press spray beam clean, the device comprising:

(a) a plurality of separate covers, each of which is configured to surround a single spray nozzle;

(b) the cover comprising a sleeve constructed to extend from the spray nozzle, and an end plate, wherein the sleeve and the end plate define an internal area within the cover and an external area outside the cover;

(c) the sleeve comprising a drainage hole and a hole for supplying compressed air to the internal area;

(d) the end plate comprising an opening within the end plate sized to maintain an overpressure region within the internal area and sized to allow a spray from the spray nozzle to leave the internal area without changing the spray;

(e) wherein when compressed air is provided through the sleeve hole to create an overpressure of compressed air in the internal area relative to the external area of the cover, and when the spray is provided from the spray nozzle, both the spray and the compressed air leave the internal area of the cover through the opening in the end plate without the spray being changed by either the end plate or the compressed air.

2. The device according to claim 1, wherein the opening in the cover has the form of a slot.

3. The device according to claim 1, wherein an external air conduit is connected to the covers.

4. The device according to claim 1, wherein a spray valve for the spray nozzle is provided with an internal air conduit and an air bore connected to the cover.

5. The device according to claim 4, wherein the air bore has such a diameter that a throttling effect is obtained.

6. A method for keeping a number of fountain solution spray nozzles in a printing press spray beam clean comprising:

(a) providing a separate cover surrounding each spray nozzle, each cover having an internal volume defined by a sleeve and an end plate, wherein an opening is provided within the end plate that is constructed to allow a spray cone from the spray nozzle to leave the internal area of the cover undisturbed and that is constructed to allow compressed air from flow control means to develop an overpressure region within the internal area and to escape the internal area without disturbing the spray cone;

(b) generating a spray cone from each spray nozzle that leaves the internal volume of the cover through the opening within the end plate and undisturbed by the end plate; and (c) generating a compressed air overpressure environment within the internal volume of each cover wherein compressed air leaves the internal volume of the cover through the opening within end plate without changing the spray leaving through the end plate.

* * * * *